United States Patent [19]

Scheibel et al.

[11] Patent Number: 4,523,398

[45] Date of Patent: Jun. 18, 1985

[54] TRACK FORMER FOR CROSS COUNTRY SKI TRACKS WITH MEANS TO MOVE FORMER TO TRANSPORT POSITION

[75] Inventors: Horst Scheibel, Dornstadt; Walter Haug, Blaustein, both of Fed. Rep. of Germany

[73] Assignee: Karl Kassbohrer Fahrzeugwerke GmbH, Ulm, Fed. Rep. of Germany

[21] Appl. No.: 650,628

[22] Filed: Sep. 14, 1984

[30] Foreign Application Priority Data

Sep. 20, 1983 [DE] Fed. Rep. of Germany ..... 3333942

[51] Int. Cl.[3] ..... E01H 4/00; E02F 3/12

[52] U.S. Cl. ..... 37/220; 37/222; 37/219; 172/140; 172/485

[58] Field of Search ..... 37/219–222; 172/197, 199, 180, 140, 392, 780, 485, 452, 458, 463, 464, 466, 467, 479

[56] References Cited

U.S. PATENT DOCUMENTS

| | | | |
|---|---|---|---|
| 2,891,335 | 6/1959 | Linneman | 172/140 |
| 3,685,404 | 8/1972 | Rich et al. | 172/197 X |
| 3,878,900 | 4/1975 | Boisse et al. | 37/219 |
| 3,915,239 | 10/1975 | Hendrichon | 172/197 X |
| 3,926,262 | 12/1975 | Brooks | 172/780 |
| 4,110,919 | 9/1978 | Henrichon | 37/219 |
| 4,122,614 | 10/1978 | Cheney | 37/219 |
| 4,341,027 | 7/1982 | Rohner | 37/219 |

FOREIGN PATENT DOCUMENTS

| | | | |
|---|---|---|---|
| 2946796 | 5/1981 | Fed. Rep. of Germany | 37/219 |
| 2269362 | 11/1975 | France | 37/219 |

*Primary Examiner*—E. H. Eickholt

*Attorney, Agent, or Firm*—M. E. Gauthier

[57] ABSTRACT

An apparatus for forming cross country ski tracks in a snow covered surface has a trailer frame adapted to be connected to the rear end of a vehicle. A lifting frame is connected to the trailer frame for pivotal movement about a first horizontal axis. The lifting frame has a pair of parallel guide members extending longitudinally from the trailer frame to a transversally extending crossbar. The guide members are arranged symmetrically on opposite sides of a central axis common to the lifting frame, the trailer frame, and the vehicle. At least one cross country ski track forming device is connected to the crossbar for pivotal movement about a second horizontal axis. A positioning device is connected between the trailer frame and the lifting frame. The positioning device pivotally manipulates the lifting frame about the first horizontal axis between an operative position at which the track forming device extends rearwardly from the trailer frame to contact and impress tracks in the snow covered surface, and an inoperative position at which the track forming device is elevated from the snow covered surface and is folded over the trailer frame.

4 Claims, 5 Drawing Figures

TRACK FORMER FOR CROSS COUNTRY SKI TRACKS WITH MEANS TO MOVE FORMER TO TRANSPORT POSITION

BACKGROUND OF THE INVENTION

1. Field of the Invention

This invention relates to snow grooming equipment, and is concerned in particular with an improved apparatus for forming cross country ski tracks.

2. Description of the Prior Art

Conventionally, cross country ski tracks are formed by initially preparing a snow-covered surface with a rotary tiller or other like device, and by then impressing the tracks into the thus prepared surface.

The rotary tiller is usually carried on a trailer frame suspended on the rear end of a tracked vehicle. The track forming devices are hitched individually to the trailer frame so as to be laterally rigid. Two guides extend rearwardly from the rear of the trailer frame. One track forming device is fastened to each of these guides. The guides themselves can be pivoted about a horizontal axis at the trailer frame. Thus, the guides can accommodate movement of the track forming devices between operative or working positions in contact with the snow covered surface, and inoperative or stowed positions angled back over the trailer frame. To move the track forming devices into one or the other of these positions, the guides each have a rigidly fastened gear wheel at the end adjacent to the horizontal pivotal axis. This gear wheel engages the toothed rod of a positioning device.

In their inoperative positions, the track forming devices are tilted backwards over the trailer frame and its rotary tiller. This improves the position of the center of gravity of the grooming equipment suspended at the rear of the vehicle. The center of gravity is moved closer to the driving axle of the vehicle.

If desired, for example when driving to a cross country ski track, the track forming devices can be lifted to their respective inoperative positions, thereby making it easier to steer the vehicle while also conserving power.

Furthermore, there also are situations where the laying of tracks is undesirable even in the case of cross country ski courses, for example at departure points. In such cases, too, the track forming devices are lifted to their inoperative positions.

SUMMARY OF THE PRESENT INVENTION

A basic object of the present invention is to provide an apparatus of the above-mentioned type, wherein the track forming devices may be folded into a much more compact inoperative arrangement, and which also has a simple, user-friendly and energy-saving means for manipulating and guiding the track forming devices.

In a preferred embodiment to be hereinafter described in more detail, this objective is achieved by employing a lifting frame. Two track forming devices are mounted on this lifting frame, at a crossbar, so as to be parallel to one another. The lifting frame has two parallel longitudinal guide members which extend between the track forming devices, from the crossbar to the trailer frame, and which are mounted on the latter so that they can pivot about a first horizontal axis. A single positioning device is connected between the trailer frame and the lifting frame for pivotally manipulating the lifting frame about the first horizontal axis so as to locate the track forming devices either in their operative or inoperative positions. The track forming devices are additionally pivotally mounted to the cross bar for pivotal movement about second horizontal axis.

The invention has a simple structure and offers many advantages.

The lifting frame is used as a central mount for the two track forming devices. However, if desired, it can also be equipped with more than two track forming device. To move the track forming devices from their operative positions to their inoperative positions and vice versa, one can use a single positioning device. Together with the lifting frame, it simultaneously moves all of the track forming devices connected thereto. In comparison to the known arrangements, the hydraulic and/or pneumatic positioning equipment for the trailer frame is thus simplified. The single positioning device of the present invention is advantageously disposed in the longitudinal center plane of the vehicle and trailer frame, so as to achieve a symmetrical distribution of forces in the lifting frame.

By virtue of the fact that the track forming devices are mounted for pivotal movement relative to the lifting frame about a second horizontal axis, they can automatically set themselves into their operative positions and can level out unevennesses in the surface being groomed. A decisive advantage of this mount appears when the track forming devices are moved from their operative positions to their inoperative positions. The track forming devices are moved in a suspended fashion from the crossbar, and when in their inoperative positions, the lifting frame is folded back onto and is supported by the trailer frame, which in turn houses the underlying rotary tiller.

The positioning device then no longer needs to support the lifting frame, but only needs to secure it. Extremely advantageous is the further reduction of the distance between the center of gravity of the track forming devices and/or the rotary tiller to the driving axle of the vehicle. If the track forming devices are set in their inoperative positions, the center of gravity is moved much closer to the driving axle as compared with conventional arrangements. This advantage is increased when the trailer frame is lifted to an inoperative position when disengaging the rotary tiller from ground level. Another advantageous feature of the present invention lies in the fact that the longitudinal guides are connected together between their respective ends by a stiffening support, which is engaged by and thus serves as the central contact point for the positioning device. Furthermore, a favorable configuration of the invention consists in providing the longitudinal guides with two arms angled to provide an inverted somewhat V-shaped configuration, such that the arm which supports the crossbar extends substantially horizontally in the operative position, with the positioning device being connected to the stiffening support at a location disposed somewhat below the junction point of the two arms.

The V-shaped longitudinal guides have one of their ends disposed relatively far down at the rear of the trailer portion which houses the rotary tiller. As a result, the horizontal mounts for the lifting frame are situated at about the height of the center of gravity of the track forming devices, when the latter are in their operative positions. Thus, tensile forces during a grooming operation are applied horizontally to the bearings of the lifting frame.

By connecting the positioning device to the lifting frame at a location below the juncture of the arms forming the V-shaped guide members, the positioning device is disposed essentially parallel to the underlying housing of the rotary tiller, regardless of the adjustment of the track forming devices.

The arms of the longitudinal guides which are approximately horizontal in the operative position, are approximately vertical in the inoperative position. Here, the track forming devices are suspended below the crossbar.

DETAILED DESCRIPTION OF ILLUSTRATED EMBODIMENT

Figure 1:
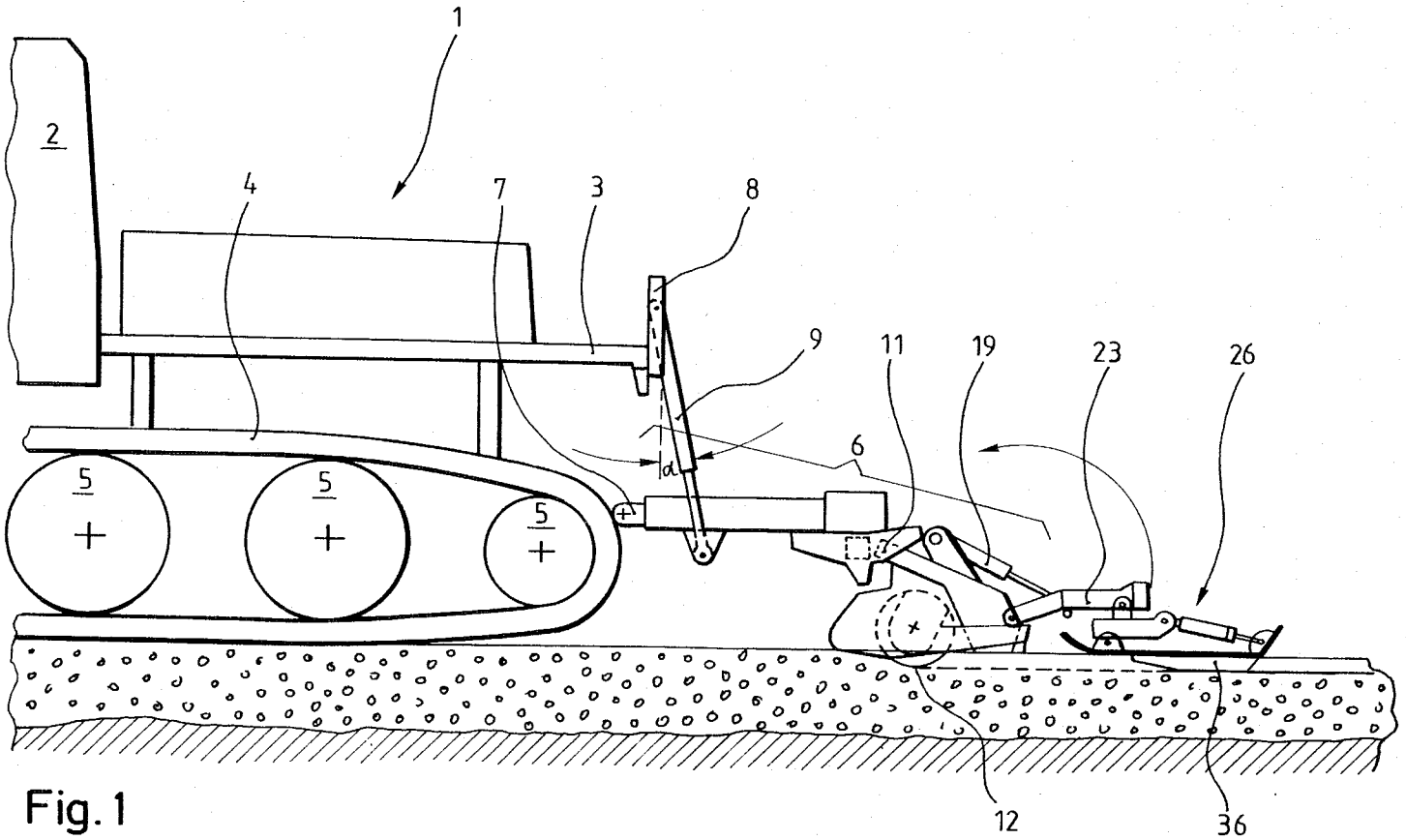
FIG. 1 shows a side view of an apparatus in accordance with the present invention.

FIG. 1 shows a snowmobile 1 of the conventional type. It has a driver cab 2 and a rearwardly extending cargo bed 3 as well as two endless caterpillar tracks 4 which are conducted over running wheels 5.

A trailer frame 6 is connected to the rear of the vehicle by means of a coupling 7. Coupling 7 accommodates both horizontal and vertical pivotal motion of the trailer frame with respect to the vehicle.

The rearward end of the support bed is provided with vertical supports 8 which are arranged laterally on either side of the longitudinal center axis L of the vehicle. These are used for mounting two positioning devices 9. In the present case, the positioning devices are inclined downwardly towards the central axis L in a somewhat trapezoidal configuration where they are attached to a central support pipe of the trailer frame 6. The support pipe extends along the longitudinal axis L of the vehicle.

The positioning devices 9 are directed steeply from the rear of the vehicle downwards. They enclose an angle of about 12° with the verticle support. All mountings of the positioning devices are adjusted in such a fashion that they may laterally manipulate the trailer frame 6 with respect to the vehicle.

Figure 2:
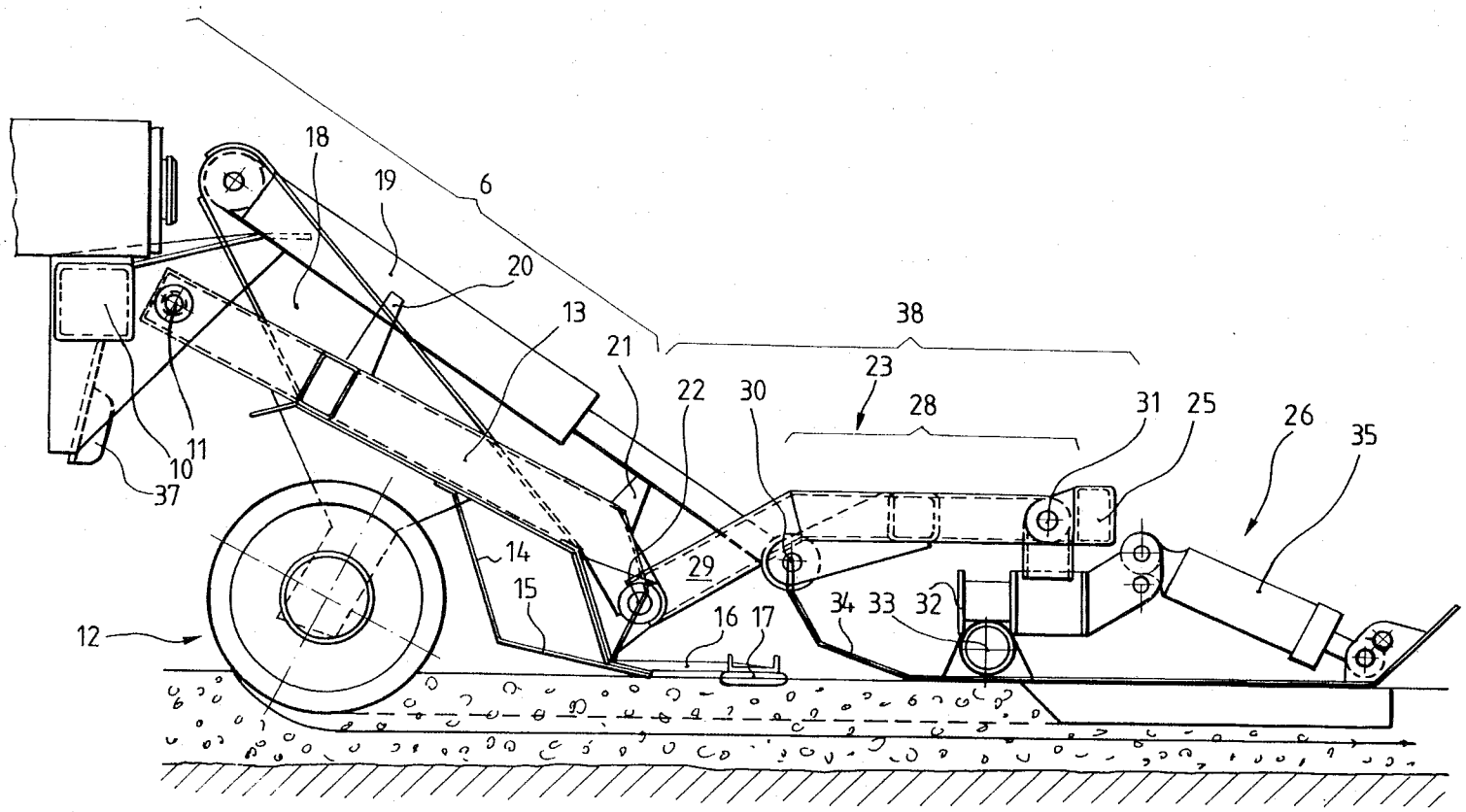
FIG. 2 shows a partial side view of the apparatus illustrated in FIG. 1, showing the rotary tiller and track forming devices in their operative positions.

As can be best seen in FIG. 2, at the rear end of the support pipe of the trailer frame 6 there is a horizontal distributor support 10 which laterally projects about $\frac{2}{3}$ of the total width of the vehicle. A rotary tiller 12 is carried beneath a housing 13 which in turn is attached to the distributor 10 for pivotal movement about horizontal axis 11. The rotary tiller is a well-known conventional device, having an array of teeth which break up compacted snow, ice, etc. and convert the same into a powdered or granular form suitable for skiing. The housing 13 has a striking surface 14 disposed behind the tiller shaft. The striking surface 14 is directed downwardly at a slant to block material being thrown upwardly by the rotary tiller. The underside of striking surface 14 forms a sliding surface 15 which runs at a slight inclination rearwardly. A finisher 17 is held at the end of the sliding surface through rubber elements 16. During the tilling process, finisher 17 is pulled along over the tilled surface. It is used to level the surface that has been planed by the sliding surface 15.

The tiller housing 13 has an essentially flat upper surface, with a mounting arm 18 extending along its longitudinal center plane. The mounting arm extends forwardly in the running direction and has a positioning device 19 pivotably mounted to its forward end.

The upper side of the tiller housing 13 has two stops 20 and 21 whose function will hereinafter be described.

Figure 5:
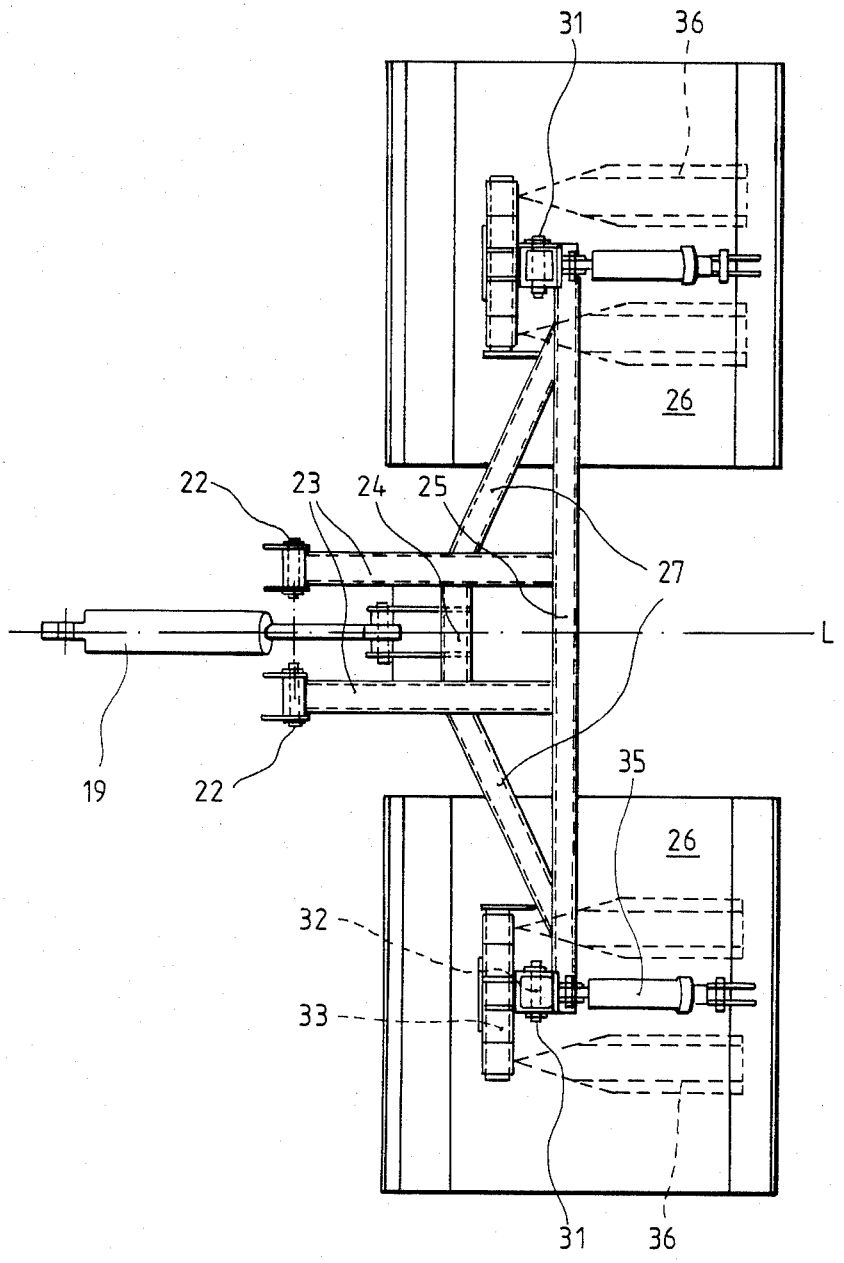
FIG. 5 shows a partial plan view of the apparatus.

Referring additionally to FIG. 5, it will be seen that at the rearward end of the tiller housing 13, longitudinal supports 23 are mounted on two coaxial horizontal axles 22. The longitudinal supports 23 are respectively connected together through a stiffening support 24 and a crossbar 25, both running at right angles with respect to the longitudinal center axis L. The crossbar 25 is disposed at the free ends of the longitudinal supports 23. In the embodiment shown, its width is such that, within the overall width of the vehicle 1, it can hold two devices 26 for forming cross country ski tracks parallel to one another. In the present case, the stiffening support is disposed at the rearward third of the longitudinal supports. A mount extends forwardly therefrom along the longitudinal center axis L. The rearward end of the above mentioned positioning device 19 is pivotably coupled to this mount.

Support arms 27 extend rearwardly at an angle from the stiffening support 24 to the crossbar 25. They serve to stabilize and support the crossbar.

As can be best seen in FIG. 2, the longitudinal guides 23 consist of horizontal arms 28 and downwardly inclined arms 29 which together form an inverted V defining an underlying obtuse angle of about 75°. The positioning device 19 is pivotally connected to the guides 23 at a bearing 30 located below the junction point of the arms 28, 29.

The track forming devices 26 are pivotably mounted, in several ways, at the free ends of the crossbar 25. A first bearing 31 has a horizontal axis, which is aligned perpendicular to the longitudinal center axis L, and which is used to take up pitching motions.

Below this is a second bearing with another horizontal axis 32, which is aligned parallel to the longitudinal center axis L. Axis 32 serves to accommodate lateral inclination of the track forming devices.

Finally, another horizontal bearing 33 is situated below the axis 32. The axis of this bearing again runs parallel to the crossbar. This bearing accommodates setting of the track forming devices during a working operation as well as positioning adjustments when moving them into their inoperative positions. By means of this, the track plates 34 can be adjusted by means of a positioning device 35, one end of which is pivotably mounted at the rearward section of the bearing 32 and the other of which is pivotably mounted at the rearward section of the track plates 34. The positioning device 34, however, is also used to load the track plates during the working process. Form pieces 36 are fastened at the underside of the track plates 34. These are used to impress the cross country ski tracks into the snow that has been preprocessed by the rotary tiller.

During a track forming operation, the vehicle 1 moves forwards (right to left as viewed in FIG. 1). Through the chains of the vehicle, the new snow is compacted and old snow is broken up. FIGS. 1 and 2 show the arrangement of the vehicle and the subsequent equipment in the operative position. The rotary tiller which follows the vehicle fragments lumps which may possibly be present. It breaks up hard snow and ice and fragments it. The rotary tiller here has its teeth set lower than the driving track of the chains of the vehicle. For this reason, it also processes the snow that exists below the level of the driving track.

The rotary tiller in its working position can be pressed downward in relation to the trailer frame 6, to attain the desired working depth.

The smoothing surface 15 and the finisher 17 level out the snow that has been processed by the rotary tiller and provide a smooth snow surface. Then, by means of the track forming devices 26, the cross country ski tracks are impressed into the surface. This is down by trailing the track forming devices behind the rotary tiller. The longitudinal guides 23 are mounted at the rear of the rotary tiller so as to be laterally rigid. They pull the track forming devices strictly behind the working path of the rotary tiller. In the working position, the lifting frame 38 is loaded by means of the positioning device 19. Thus, the track forming devices are pressed by the crossbar 25 into the freshly prepared snow, and an exact formation of the cross country ski tracks is achieved by means of the form pieces 36.

The positioning device 35 is used to secure the proper setting of the track plates 34 and of the form pieces 36.

In certain situations, it is desirable to lift the track forming devices either relative to or together with the rotary tiller. For example, this may be the case when crossing a road, when preparing a departure point or an approach to a cross country ski course, etc.

Figure 3:
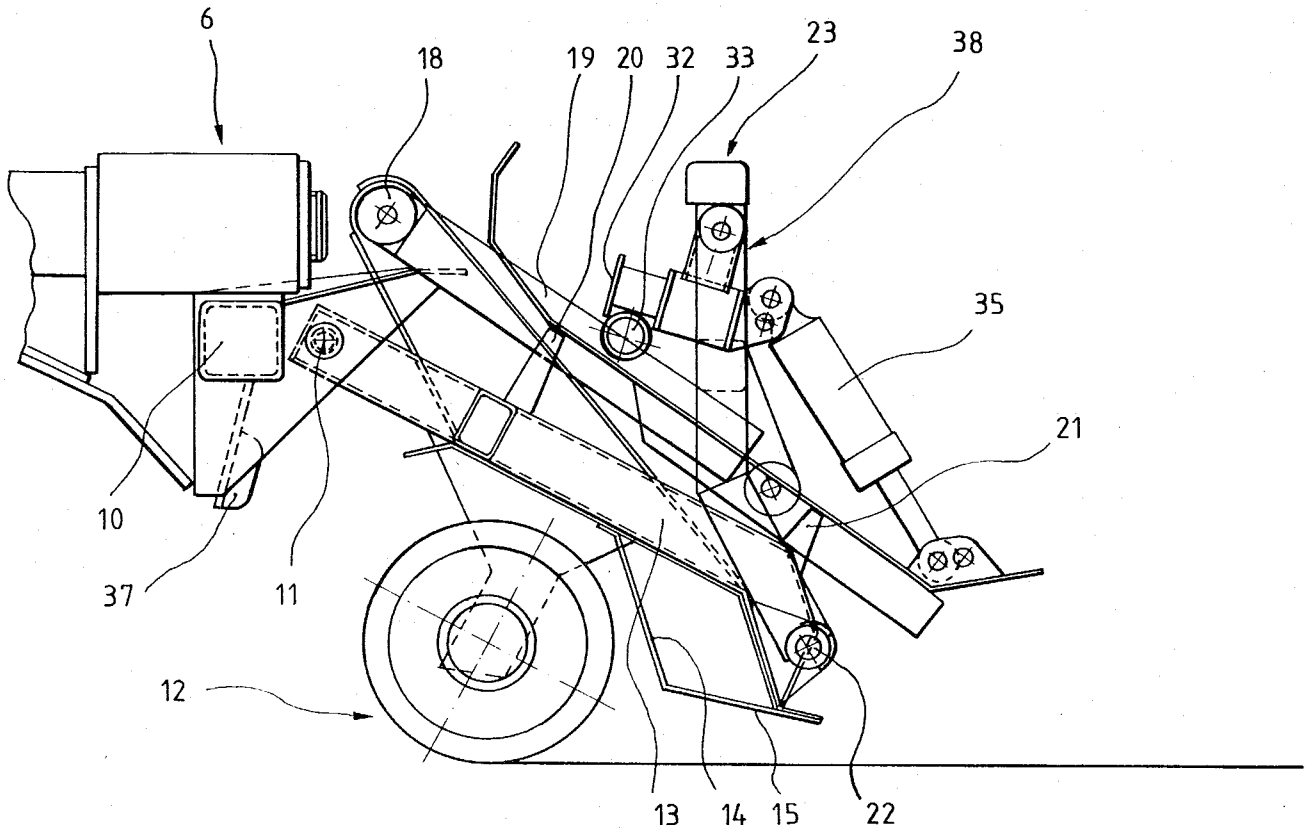
FIG. 3 is a view similar to FIG. 2, with the track forming devices raised to their inoperative positions.

If one wishes to lift off only the track forming devices, it is sufficient to activate the centrally disposed positioning device 19 while the rotary tiller remains in its working position. The track forming devices are suspended from the crossbar 25 as they are lifted and swing over the trailer frame. Eventually, as shown in FIG. 3, they are deposited in inoperative or stowed positions on the stops 20 and 21. The positioning device 35 is adjusted to accommodate this disposition.

The track forming devices have thus been moved very closely to the tiller housing. This decisively reduces the distance of the center of gravity of the attached devices from the driving axle 5 of the vehicle 1, where this driving axle 5 is disposed at the rear of the vehicle. The track forming devices are secured in their position by the positioning device 19, without the positioning device here needing to bear the weight of track forming devices.

The design of the longitudinal guides 23 favors the compact retraction of the track forming devices.

Figure 4:
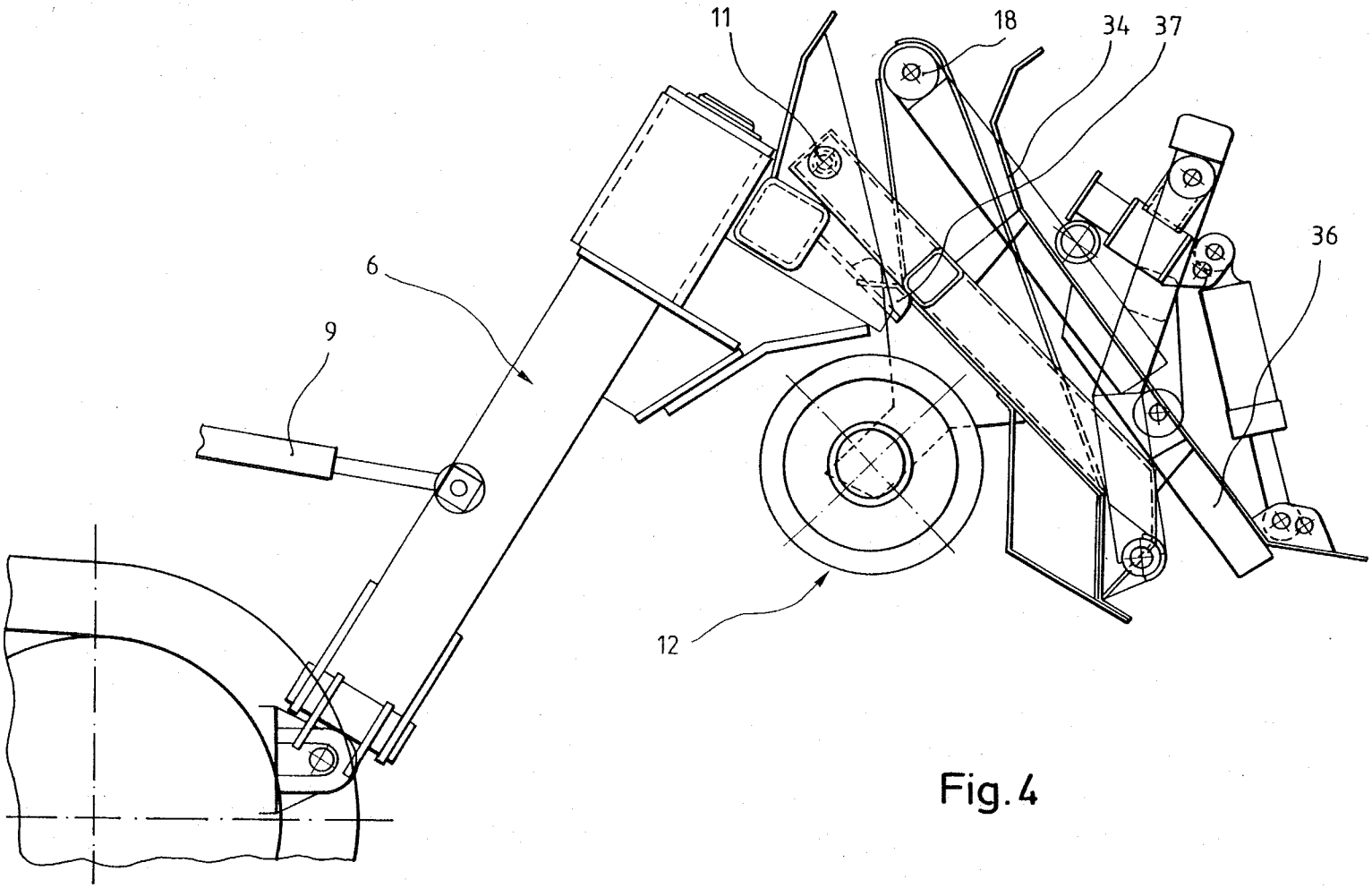
FIG. 4 is another view similar to FIGS. 2 and 3, showing both the rotary tiller and the track forming devices raised to their inoperative positions.

If the rotary tiller is to be lifted off in addition to the track forming devices, this is done simply by activating the positioning devices 9. These raise the trailer frame 6, thus allowing the rotary tiller together with the inoperatively positioned track forming devices to pivot downwardly about the axis 11, coming to a stop against the rubber bumpers 37. This position is shown in FIG. 4. It can be seen that here both the rotary tiller and the track forming devices are again moved close to the rear of the vehicle 1 and thus close to the driving axle 5. When the trailer frame 6 has been raised up, it is simultaneously secured against lateral pivoting, through the trapezoidal arrangement of the positioning devices 9. Both the trailer frame and the lifting frame are disposed symmetrically with respect to the longitudinal center axis L.

The invention is not limited to the embodiment shown. In particular, it is conceivable to provide the lifting frame with one or more than two track forming devices. Furthermore, it is conceivable to replace the two parallel longitudinal guides by a single one. It is also possible to provide longitudinal guides, not along the longitudinal center axis of the vehicle between the track forming devices, but rather outside of the latter.

We claim:

1. Apparatus for forming cross country ski tracks in a snow covered surface, comprising:

a trailer frame adapted to be connected to the rear end of a vehicle;

a lifting frame connected to said trailer frame for pivotal movement about a first horizontal axis, said lifting frame having a pair of parallel guide members extending longitudinally from said trailer frame to a transversally extending crossbar, said guide members being arranged symmetrically on opposite side of a central axis common to the lifting frame, the trailer frame, and the vehicle;

at least one cross country ski track forming device connected to said crossbar, said track forming device being pivotably movable about a second horizontal axis; and positioning means connected between said trailer frame and said lifting frame for pivotally manipulating said lifting frame about said first horizontal axis between an operative position at which said track forming device extends rearwardly from said trailer frame to contact and impress tracks in the snow covered surface, and an inoperative position at which said track forming device is elevated from said surface and is folded over said trailer frame.

2. The apparatus of claim 1 further comprising a stiffening support extending laterally between said guide members, said positioning means being connected at one end to said stiffening support.

3. The apparatus of either claim 1 or 2 wherein said guide members each have first and second arms, said first arms being connected to said trailer frame at said first axis, and said second arms being connected to said crossbar, said first and second arms being angularly disposed with respect to each other such that when said lifting frame is in said operative position, said first and second arms define downwardly facing obtuse angles with said second arms being arranged substantially horizontally.

4. The apparatus of claim 3 wherein said positioning means is connected to said lifting frame at a location below the junction between said first and second arms.

* * * * *